US008281476B2

(12) United States Patent
Hur et al.

(10) Patent No.: US 8,281,476 B2
(45) Date of Patent: Oct. 9, 2012

(54) MULTILAYERED TUBE AND MANUFACTURING METHOD THEREOF BASED ON HIGH PRESSURE TUBE HYDROFORMING

(75) Inventors: Ju Haeng Hur, Ulsan (KR); Dong Hyun Jeon, Ulsan (KR); Yun Gyu Kim, Ulsan (KR); Hyo Sub Kim, Ulsan (KR); Sang Muk Na, Jeollanam-Do (KR)

(73) Assignee: Hyundai Hysco (KR)

( * ) Notice: Subject to any disclaimer, the term of this patent is extended or adjusted under 35 U.S.C. 154(b) by 330 days.

(21) Appl. No.: 12/810,274

(22) PCT Filed: Jan. 28, 2009

(86) PCT No.: PCT/KR2009/000402

§ 371 (c)(1), (2), (4) Date: Jun. 23, 2010

(87) PCT Pub. No.: WO2010/071259

PCT Pub. Date: Jun. 24, 2010

(65) Prior Publication Data

US 2011/0120585 A1 May 26, 2011

(30) Foreign Application Priority Data

Dec. 19, 2008 (KR) ..... 10-2008-0130667

(51) Int. Cl.
*B21D 39/08* (2006.01)
*B21D 26/02* (2006.01)
*F16B 12/04* (2006.01)

(52) U.S. Cl. ..... 29/523; 72/61; 72/62; 72/370.22; 29/421.1; 29/512

(58) Field of Classification Search ..... 29/523, 29/421.1; 72/54–63
See application file for complete search history.

(56) References Cited

U.S. PATENT DOCUMENTS 6,701,598 B2 * 3/2004 Chen et al. ..... 29/421.1
(Continued)

FOREIGN PATENT DOCUMENTS

JP 8-332534 12/1996
(Continued)

*Primary Examiner* — Derris Banks
*Assistant Examiner* — Anthony Green
(74) *Attorney, Agent, or Firm* — Baker & Hostetler LLP

(57) ABSTRACT

Disclosed is a method of manufacturing a multilayered tube, including: preparing an outer tube, an inner tube having an outer diameter of 95~98% of an inner diameter of the outer tube, and dies with a shaping void having a diameter of 100.20~100.30% of an outer diameter of the outer tube; mounting the outer tube on the shaping void, with the inner tube inserted into the outer tube; plastically expanding the inner tube to be brought into contact with the outer tube by injecting a fluid into the inner tube until a pressure of the fluid reaches a first forming pressure inside the inner tube; elastically expanding the outer tube to be brought into contact with the shaping void by increasing the pressure of the fluid until the pressure of the fluid reaches a second forming pressure inside the inner tube; and elastically recovering the outer tube to allow the outer tube and the inner tube to be coupled to each other by removing the fluid from the inner tube, wherein the first forming pressure is in the range of 10~20% of yield strength of the inner tube, and the second forming pressure is in the range of 10~20% of yield strength of the outer tube and is maintained for 2~3 seconds.

12 Claims, 4 Drawing Sheets

U.S. PATENT DOCUMENTS

| | | | | |
|---|---|---|---|---|
| 6,842,956 | B1 * | 1/2005 | Amborn et al. | 29/421.1 |
| 6,948,225 | B2 * | 9/2005 | Smith | 29/421.1 |
| 2004/0146340 | A1 * | 7/2004 | Smith | 403/265 |
| 2004/0216298 | A1 * | 11/2004 | Gibson | 29/516 |

FOREIGN PATENT DOCUMENTS

| | | |
|---|---|---|
| JP | 10-052721 | 2/1998 |
| JP | 2001-062522 | 3/2001 |
| JP | 2004-322122 | 11/2004 |

* cited by examiner inner Pressure vs End Feeding Amount

MULTILAYERED TUBE AND MANUFACTURING METHOD THEREOF BASED ON HIGH PRESSURE TUBE HYDROFORMING

TECHNICAL FIELD

The present invention relates to a multilayered tube and a manufacturing method thereof based on high pressure tube hydroforming. The present invention provides a manufacturing method of a multilayered tube, in which an inner tube is expanded to undergo plastic deformation inside an outer tube by applying hydraulic pressure, and the outer tube is elastically expanded by the plastic expansion of the inner tube and undergoes elastic contraction upon removal of the pressure, thereby allowing the inner tube and the outer tube to be firmly coupled to each other without the use of separate adhesives.

BACKGROUND ART

High pressure tube hydroforming is a multiphase forming technique that forms a tube-shaped workpiece into a desired shape by placing the workpiece in dies having a shaping void of a desired shape and injecting fluid, for example, water, into the tube under high pressure, instead of separately machining workpieces with various press dies and then welding the machined workpieces to each other, when forming complex components. The hydroforming is a tube forming technique that has a high material recovery degree and high productivity.

Generally, typical double/multilayered tubes are fabricated by filling adhesives or synthetic resin in a space between inner and outer tubes to couple the inner and outer tubes to each other or by heating or cooling the inner or outer tube for heat shrink fitting.

However, such tubes have problems as follows.

First, for the double/multilayered tubes produced by coupling the inner tube and the outer tube using the adhesives, a bonding force between the inner and outer tubes can be weakened due to chemical changes of the adhesives resulting from variation of surrounding temperatures or conditions.

Second, application of the adhesives or filling of the synthetic resin requires complicated processes, such as surface treatment, solidification, and the like, thereby reducing productivity.

Third, the adhesives or the synthetic resin are not decomposed even after extended periods of time and cause an increase in manufacturing costs as well.

Fourth, the heat treatment for heat shrink fitting requires expensive heat treatment equipment and cannot achieve uniform coupling over the surfaces of the tubes when the tubes have an elongated shape.

DISCLOSURE

Technical Problem

An aspect of the present invention is to provide a multilayered tube and a manufacturing method thereof, which can eliminate heat treatment for heat shrink fitting or the use of chemical fillers or adhesives for bonding inner and outer tubes, and in which an inner tube is expanded and brought into close contact with an outer tube through plastic deformation by high pressure tube hydroforming, and the outer tube is sequentially subjected to elastic and plastic deformation by an expanding force of the inner tube to be mechanically coupled with the inner tube through elastic recovery of the outer tube.

Another aspect of the present invention is to provide a manufacturing method of a multilayered tube that has high coupling force between inner and outer tubes by setting suitable dimensions of the inner tube and a shaping void of dies with reference to the outer tube.

A further aspect of the present invention is to provide a multilayered tube and a manufacturing method thereof that can further enhance coupling force by imparting surface roughness to the inner and outer tubes.

Technical Solution

In accordance with an aspect of the invention, a method of manufacturing a multilayered tube includes: preparing an outer tube, an inner tube having an outer diameter of 95~98% of an inner diameter of the outer tube, and dies with a shaping void having a diameter of 100.20~100.30% of an outer diameter of the outer tube; mounting the outer tube on the shaping void, with the inner tube inserted into the outer tube; plastically expanding the inner tube to be brought into contact with the outer tube by injecting a fluid into the inner tube until a pressure of the fluid reaches a first forming pressure inside the inner tube; elastically expanding the outer tube to be brought into contact with the shaping void by increasing the pressure of the fluid until the pressure of the fluid reaches a second forming pressure inside the inner tube; and elastically recovering the outer tube to allow the outer tube and the inner tube to be coupled to each other by removing the fluid from the inner tube, wherein the first forming pressure is in the range of 10~20% of yield strength of the inner tube, and wherein the second forming pressure is in the range of 10~20% of yield strength of the outer tube and is maintained for 2~3 seconds.

Advantageous Effects

According to the invention, the double/multilayered tube is fabricated by high pressure tube hydroforming, wherein an inner tube is expanded and brought into close contact with an outer tube through plastic deformation and the outer tube is subjected to elastic and plastic deformation by an expanding force of the inner tube so that the inner tube is mechanically coupled to the outer tube, instead of using chemical fillers or adhesives between the inner and outer tubes, or heating or cooling the inner or outer tube for heat shrink fitting.

The double/multilayered tube has good coupling strength and does not require separate heat treatment or use of adhesives/synthetic resin, thereby enhancing productivity and workability while reducing manufacturing costs.

Further, the invention permits various combinations of inner and outer tubes depending on the use of finished tubes and can produce various components according to shapes of shaping voids in dies used for high pressure tube hydroforming.

BEST MODE

Exemplary embodiments of the invention will now be described with reference to accompanying drawings.

Figure 1:
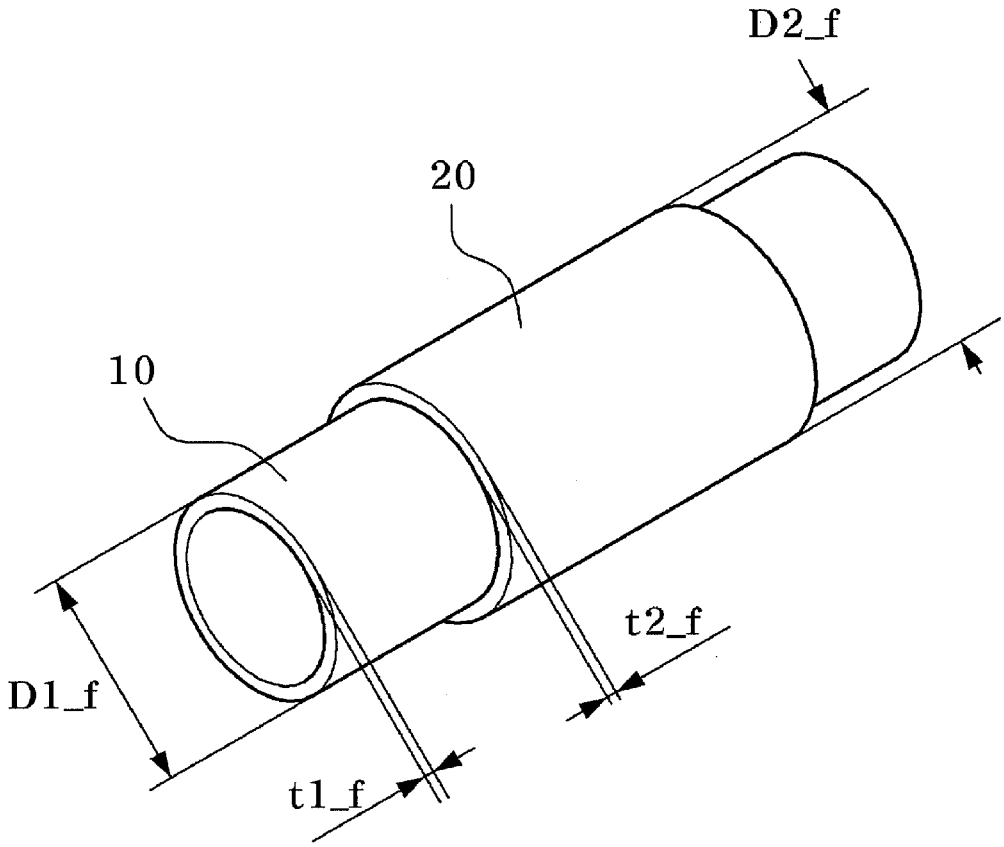
FIG. 1 is a perspective view of a finished product of a double-layered tube in accordance with one embodiment of the present invention.

FIG. 1 is a perspective view of a finished product of a double-layered tube in accordance with one embodiment of the present invention.

Referring to FIG. 1, a double-layered tube of this embodiment includes an inner tube 10 and an outer tube 20 mechanically coupled to each other without separate adhesives or welding.

A method of manufacturing the double-layered tube using the inner tube 10 and the outer tube 20 provided as finished products will now be described. Here, the inner tube 10 is designed to have an outer diameter D1_f and a thickness t1_f, and the outer tube 20 is designed to have an outer diameter D2_f and a thickness t2_f.

In the double-layered tube according to this embodiment, an outer surface of the inner tube is coupled to an inner surface of the outer tube by friction that is generated between the outer surface of the inner tube and the inner surface of the outer tube by an elastic contraction force of the outer tube.

Thus, a certain surface roughness may be provided to the outer surface of the inner tube or to the inner surface of the outer tube to increase coupling strength and coupling force.

According to test results described below, it is desirable for the outer surface of the inner tube or the inner surface of the outer tube to have a surface roughness in the range 25~75 μM.

The tubes are illustrated as having circular cross-sections in this embodiment, but may have other cross-sectional shapes, such as an elliptical cross-section, a rectangular cross-section, a hexagonal cross-section, an octagonal cross-section, and the like.

The inner and outer tubes are made of ferrous metal, such as general carbon steel, stainless steel tube, aluminum tube, copper (Cu) tube, etc., or are made of non-ferrous metal. Here, the inner and outer tubes may be made of the same or different materials. Further the inner and outer tubes may be manufactured into a multi-structure including two or more layers, that is, a three or more layer structure.

Figure 2:
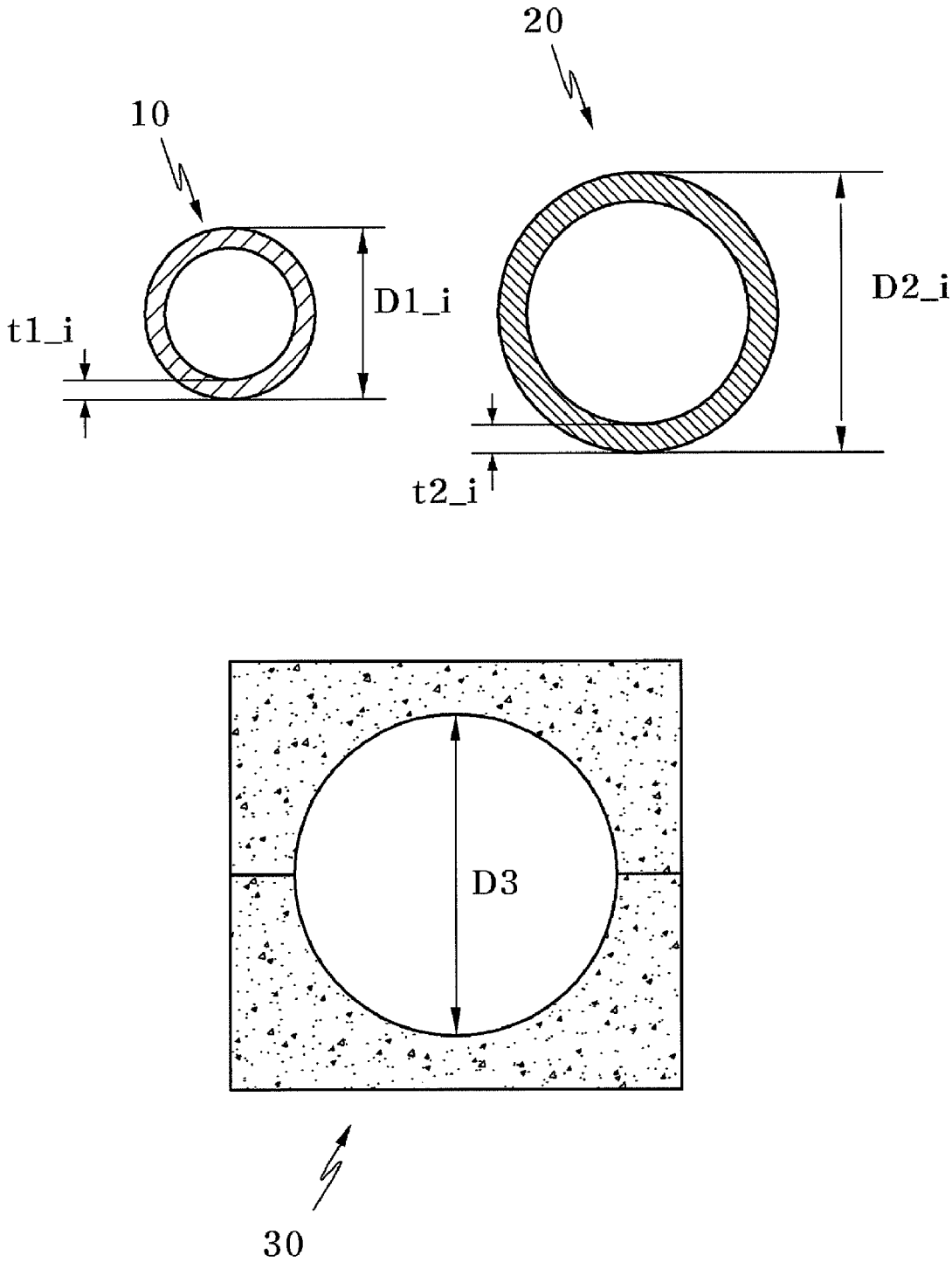
FIG. 2 is a cross-sectional view of dies and inner and outer tubes before shaping into the double-layered tube of FIG. 1.

FIG. 2 is a cross-sectional view of dies and inner and outer tubes before shaping into the double-layered tube of FIG. 1

Before forming, the inner tube has an outer diameter D1_i and a thickness t1_i, and the outer tube 20 has an outer diameter D2_i and a thickness t2_i.

Before forming, the outer diameter D1_i of the inner tube 10 is smaller than the outer diameter D1_f of the inner tube 10 as a finished product, and the thickness t1_i of the inner tube 10 is thicker than the thickness t1_f of the inner tube 10 as the finished product.

That is, as the outer diameter of the inner tube is expanded by forming, the thickness of the inner tube is decreased.

Such variations of the outer diameter and the thickness of the inner tube before and after the forming also occur in the outer tube.

The inner tube 10 undergoes plastic deformation, whereas the outer tube 20 sequentially undergoes elastic expansion and elastic contraction.

Thus, it is necessary for the inner and outer tubes 10 and 20 to be manufactured in consideration of such variations in thickness and diameter rather than the dimensions of finished products.

Design of the dimensions in consideration of the variations in thickness and diameter may be achieved by forming analysis based on simulation (simulated forming experiment) or repetitious experiments and trial and error.

Before forming, the outer diameter of the inner tube 10 is smaller than the inner diameter of the outer tube 20.

After the inner tube 10 is expanded to contact the outer diameter 20, the inner tube 10 continues to be expanded until the outer diameter 20 contacts the dies.

The inner tube 10 undergoes plastic deformation by expansion. When the inner tube 10 expands only in an elastic deformation region, the inner tube 10 returns back to an original state and cannot be coupled to the outer tube 20 upon removal of inner pressure.

According to test results, it is preferable for the inner tube 10 to have an expansion ratio in the range of 3~5% when the inner and outer tubes have an outer diameter in the range of 21.0~660.4 mm and a thickness in the range of 0.8~27.0 mm. Thus, the outer diameter of the inner tube 10 is in the range of 95~90% of the inner diameter of the outer tube 20.

When the inner tube 10 expands in a ratio of 3% or less, coupling force is lowered, and when the inner tube 10 expands in a ratio of 5% or more, there is a likelihood of surface defect formation or failure.

After being inserted into the outer tube, the inner tube 10 is expanded to undergo plastic deformation by hydraulic pressure, and thus, the outer tube 20 is also subjected to elastic deformation by the expansion of the inner tube 10. Here, dies 30 having a predetermined shaping void are provided to control the expansion of the outer tube 20.

Diameter D3 of the shaping void in the dies 30 may be in the range of 100.20~100.30% of the diameter of the outer tube before forming. The shaping void serves to restrict the expansion range of the outer tube. When the outer tube expands in a ratio of 100.20% or less, the coupling force is weakened, and when the outer tube expands in a ratio of 100.30%, the outer tube also undergoes plastic deformation, thereby lowering the coupling force.

Since it is necessary for the outer tube 20 to sequentially undergo elastic expansion in an elastic deformation range and elastic contraction resulting from removal of the pressure, it is important to control the expansion range of the outer tube 20. To this end, the present invention controls the expansion ratio of the outer tube 20 based on the diameter D3 of the shaping void in the dies 30.

Figure 3:
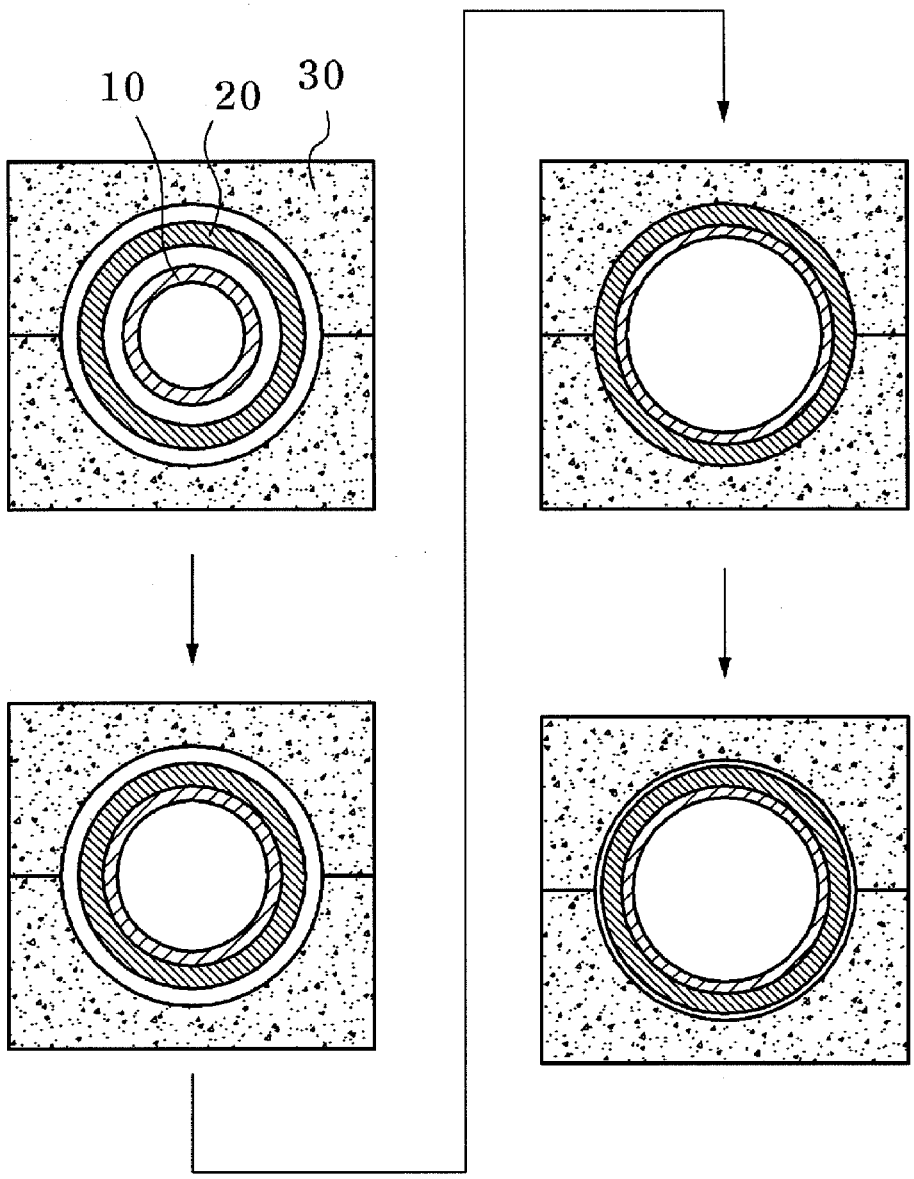
FIG. 3 is a flow diagram of a process of manufacturing a multilayered tube using high pressure tube hydroforming in accordance with one embodiment of the present invention.

FIG. 3 is a flow diagram of a process of manufacturing a multilayered tube using high pressure tube hydroforming in accordance with one embodiment of the invention.

After preparing an inner tube 10, an outer tube 20, and dies 30 as shown in FIG. 2, the outer tube 20 is mounted on the dies 30, with the inner tube 10 inserted into the outer tube 20, as shown in an upper side of FIG. 3.

Here, predetermined gaps are formed between the inner tube 10 and the outer tube 20, and between the outer tube 20 and the dies 30.

Figure 4:
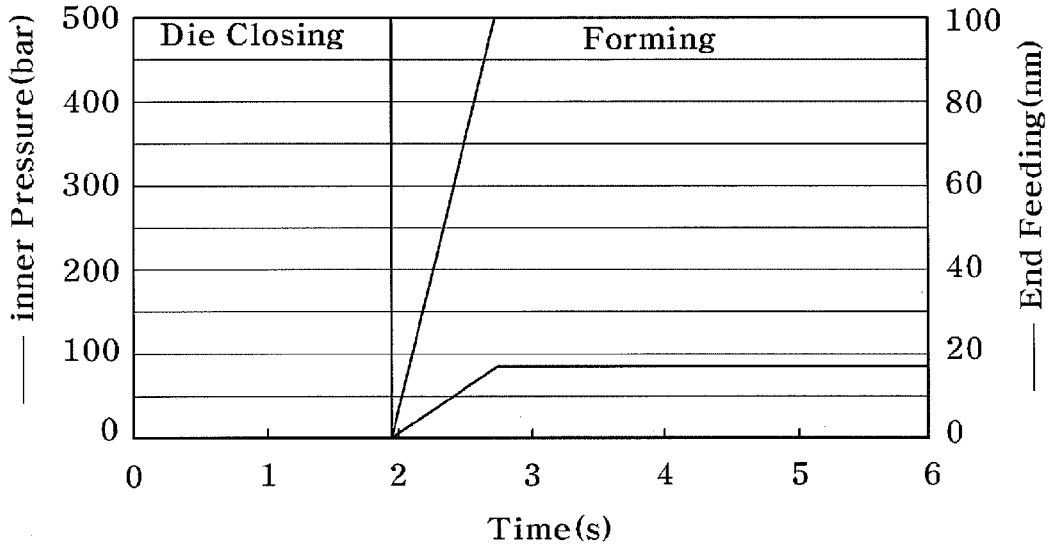
FIG. 4 is a graph depicting fluid pressure applied to an inner tube and an end-feeding amount depending on time.

Then, with both sides of the inner tube 10 closed, fluid is injected into the inner tube 10 to increase pressure inside the inner tube 10, as depicted in the graph of FIG. 4, such that the inner tube 10 can be expanded. First, the pressure of the fluid is increased inside the inner tube to a first forming pressure which forces the inner tube 10 to be deformed and brought into close contact with the outer tube 20, as shown in a left lower side of FIG. 3.

Here, since too rapid or excessive increase of the pressure can lead to non-uniform expansion of the inner tube 10, the first forming pressure is preferably in the range of 10~20% of the yield strength of the inner tube, and more preferably in the range of 10~12% thereof.

When the inner tube 10 is brought into close contact with the outer tube 20 and secured thereto, the pressure of the fluid is further increased to a second forming pressure and is then maintained for 2~3 seconds.

The second forming pressure is preferably in the range of 10~20% of the sum of the yield strength of the inner tube 10 and the yield strength of the outer tube 20, and more preferably in the range of 10~12% thereof.

If the forming pressure is less than the aforementioned pressure, there is the likelihood of incomplete forming, and if the forming pressure exceeds the aforementioned pressure, there is a likelihood of non-uniform forming or deterioration in surface quality.

The second forming pressure causes the inner tube 10 and the outer tube 20 to be expanded together until the outer tube 20 is brought into close contact with the dies 30.

Then, when the fluid is removed from the inner tube to remove the pressure imparted to the inner tube, the outer tube is mechanically coupled with the outer surface of the inner tube as it is elastically contracted.

FIG. 4 is a graph depicting a fluid pressure applied to an inner tube and an end-feeding amount depending on time.

As shown in FIG. 4, when the fluid pressure is increased with the dies closed, axial end-feeding is started.

Herein, the axial end-feeding refers to compressing the inner tube at opposite sides thereof and is carried out to maintain air-tightness for the fluid injected into the inert tube while aiding expansion of the inner tube.

The fluid pressure is increased to the second forming pressure and is maintained at this pressure for a while before final removal.

The axial end-feeding amount is increased in proportional to an increase of the fluid pressure and is neither further increased nor decreased at the time of maintaining the second forming pressure.

In the embodiment shown in the drawings, the inner tube is mechanically coupled with an inner peripheral surface of the outer tube by friction, so that the inner tube and the outer tube have the same center. However, the inner and outer tubes may be manufactured to have various shapes, such as an elliptical shape, a rectangular shape, a hexagonal shape, an octagonal shape, and the like.

Namely, the inner and outer tube may be shaped to have various other shapes, such as an elliptical shape, a rectangular shape, a hexagonal shape, an octagonal shape, etc., instead of the circular shape, depending on the shape of the dies for high pressure tube hydroforming which comes into contact with the outer tube about the same center such that the outer peripheral surface of the inner tube has the same bonding surface and the same mechanical friction as the inner peripheral surface of the outer tube.

The inner and outer tubes are made of ferrous metal, such as general carbon steel tubes, stainless steel tubes, aluminum tubes, copper (Cu) tubes, etc., or are made of non-ferrous metal. Here, the inner and outer tubes may be made of the same or different materials. Further the inner and outer tubes may be manufactured into a multi-structure including two or more layers, that is, a three or more layer structure.

Like the double-layered tube, a triple-layered tube includes a shaping void, an outer tube and an inner tube, and further includes a second inner tube, which has a smaller outer diameter than the inner tube.

After sequentially coupling the second inner tube, the inner tube, the outer tube and the shaping void, pressure is applied to the second inner tube to allow the second inner tube to expand the inner tube through plastic expansion, and the outer tube is elastically expanded by the expansion of the second inner tube and the inner tube. Then, by removing the pressure, the second inner tube, the inner tube, and the outer tube are coupled to one another through elastic recovery of the outer tube.

A method of manufacturing a triple-layered tube according to one embodiment of the invention will be described in more detail. This method includes: preparing an outer tube, an inner tube having an outer diameter of 95~98% of an inner diameter of the outer tube, a second inner tube having an outer diameter of 95~98% of an inner diameter of the inner tube, and dies with a shaping void having a diameter of 100.20~100.30% of an outer diameter of the outer tube; mounting the outer tube on the shaping void, with the inner tube and the second inner tube inserted into the outer tube; plastically expanding the second inner tube to be brought into contact with the inner tube and to force the inner tube to be brought into contact with the outer tube by an expanding force of the second inner tube by injecting a fluid into the second inner tube until a pressure of the fluid reaches a first forming pressure inside the second inner tube; elastically expanding the outer tube to be brought into contact with the shaping void by increasing the pressure of the fluid until the pressure of the fluid reaches a second forming pressure inside the second inner tube; and elastically recovering the outer tube to allow the outer tube, the inner tube and the second inner tube to be coupled to one another by removing the fluid from the second inner tube.

Here, the first forming pressure may be in the range of 10~20% of the sum of yield strengths of the inner tube and the second inner tube, and the second forming pressure may be in the range of 10~20% of the sum of the yield strengths of the second inner tube, the inner tube and the outer tube. The second forming pressure may be maintained for 2~3 seconds.

Next, the present invention will be described in more detail with reference to examples in conjunction with the drawings.

EXAMPLES

1) Coupling strength between an inner tube and an outer tube was measured by changing only an expansion ratio of the inner tube under the same conditions in order to observe variation in coupling strength depending on the expansion ratio of the inner tube.

Testing conditions (thickness of inner tube: 2.0 mm, outer diameter of outer tube: 55.0 mm, thickness of outer tube: 2.5 mm, inner diameter of outer tube: 50.0 mm, first forming pressure: 250 bars, second forming pressure: 500 bars)

Table 1 shows the variation in coupling strength depending on the expansion ratio of the inner tube.

TABLE 1

| | Outer diameter of inner tube (mm) | Ratio to inner diameter of outer tube (%) | Expansion ratio (%) | Coupling strength |
|---|---|---|---|---|
| 1 | 49.75 | 99.5 | 0.5 | 20 MPa |
| 2 | 49.6 | 99.2 | 0.8 | 30 MPa |
| 3 | 49.5 | 99.0 | 1.0 | 50 MPa |
| 4 | 48.5 | 97.0 | 3.0 | 70 MPa |
| 5 | 47.5 | 95.0 | 5.0 | 100 MPa |
| 6 | 46.5 | 93.0 | 7.0 | 50 MPa |

As shown in Table 1, the test results show that the expansion ratio in the range of 3.0~5% ensures good coupling strength.

2) Coupling strength between an inner tube and an outer tube was measured by changing only the size of the shaping void under the same conditions in order to observe variation in coupling strength depending on the size of the shaping void with respect to the outer diameter of the outer tube.

Testing conditions (outer diameter of inner tube: 48.6 mm, thickness of inner tube: 2.0 mm, outer diameter of outer tube: 55.0 mm, thickness of outer tube: 2.5 mm, inner diameter of outer tube: 50.0 mm, first forming pressure: 250 bars, second forming pressure: 500 bars)

Table 2 shows the variation in coupling strength depending on the size of the shaping void.

TABLE 2

| | Diameter of shaping void (mm) | Ratio to outer diameter of outer tube (%) | Coupling strength |
|---|---|---|---|
| 1 | 56.02 | 100.05 | 15 MPa |
| 2 | 55.06 | 100.10 | 20 MPa |
| 3 | 55.08 | 100.15 | 30 MPa |
| 4 | 55.11 | 100.20 | 100 MPa |
| 5 | 55.16 | 100.30 | 90 MPa |
| 6 | 55.19 | 100.35 | 50 MPa |

3) Coupling strength between an inner tube and an outer tube was measured by changing only surface roughness of the inner and outer tubes under the same conditions in order to observe variation in coupling strength depending on the surface roughness of the inner and outer tubes.

Testing conditions (outer diameter of inner tube: 48.6 mm, thickness of inner tube: 2.0 mm, outer diameter of outer tube: 55.0 mm, thickness of outer tube: 2.5 mm, inner diameter of outer tube: 50.0 mm, first forming pressure: 350 bars, second forming pressure: 500 bars)

Table 3 shows the variation in coupling strength depending on the surface roughness.

TABLE 3

| | Surface roughness of inner tube (Ra) | Surface roughness of outer tube (Ra) | Coupling strength |
|---|---|---|---|
| 1 | 5 μm | 5 μm | 30 MPa |
| 2 | 25 μm | 25 μm | 100 MPa |
| 3 | 50 μm | 50 μm | 100 MPa |
| 4 | 75 μm | 75 μm | 100 MPa |
| 5 | 100 μm | 100 μm | 25 MPa |
| 6 | 125 μm | 125 μm | 10 MPa |

The test results show that, when each of the inner and outer tubes has a surface roughness of 25~75 μm, coupling strength is maximized.

The invention claimed is:

1. A method of manufacturing a multilayered tube, comprising:

preparing an outer tube, an inner tube having an outer diameter of 95~98% of an inner diameter of the outer tube, and dies with a shaping void having a diameter of 100.20~100.30% of an outer diameter of the outer tube;

mounting the outer tube on the shaping void, with the inner tube inserted into the outer tube;

plastically expanding the inner tube to be brought into contact with the outer tube by injecting a fluid into the inner tube until a pressure of the fluid reaches a first forming pressure inside the inner tube;

elastically expanding the outer tube to be brought into contact with the shaping void by increasing the pressure of the fluid until the pressure of the fluid reaches a second forming pressure inside the inner tube; and elastically recovering the outer tube to allow the outer tube and the inner tube to be coupled to each other by removing the fluid from the inner tube, wherein the first forming pressure is in the range of 10~20% of yield strength of the inner tube, and wherein the second forming pressure is in the range of 10~20% of yield strength of the outer tube and is maintained for 2~3 seconds.

2. The method according to claim 1, wherein an inner surface of the outer tube has a surface roughness Ra of 25~75 μm and an outer surface of the inner tube has a surface roughness Ra of 25~75 μm.

3. The method according to claim 1, wherein the outer tube has an outer diameter of 21.0~660.4 mm and a thickness of 0.8~27.0 mm, and the shaping void has a diameter of 100.20~100.30% of the diameter of the outer tube.

4. The method according to claim 1, wherein the outer tube has an outer diameter of 21.0~660.4 mm and a thickness of 0.8~27.0 mm, and the inner tube has an outer diameter of 95~98% of the inner diameter of the outer tube and a thickness of 0.8~27.0 mm.

5. A method of manufacturing a multilayered tube, comprising:

preparing an outer tube, an inner tube having an outer diameter of 95~98% of an inner diameter of the outer tube, a second inner tube having an outer diameter of 95~98% of an inner diameter of the inner tube, and dies with a shaping void having a diameter of 100.20~100.30% of an outer diameter of the outer tube;

mounting the outer tube on the shaping void, with the inner tube and the second inner tube inserted into the outer tube;

plastically expanding the second inner tube to be brought into contact with the inner tube and to force the inner tube to be brought into contact with the outer tube by an expanding force of the second inner tube by injecting a fluid into the second inner tube until a pressure of the fluid reaches a first forming pressure inside the second inner tube;

elastically expanding the outer tube to be brought into contact with the shaping void by increasing the pressure of the fluid until the pressure of the fluid reaches a second forming pressure inside the second inner tube; and elastically recovering the outer tube to allow the outer tube, the inner tube and the second inner tube to be coupled to one another by removing the fluid from the second inner tube, wherein the first forming pressure is in the range of 10~20% of the sum of yield strengths of the inner tube and the second inner tube, and wherein the second forming pressure is in the range of 10~20% of the sum of the yield strengths of the second inner tube, the inner tube and the outer tube, and is maintained for 2~3 seconds.

6. The method according to claim 5, wherein an inner surface of the outer tube has a surface roughness Ra of 25~75 μm, and inner and outer surfaces of the inner tube have a surface roughness Ra of 25~75 μm, and an outer surface of the second inner tube has a surface roughness Ra of 25~75 μm.

7. A multilayered tube manufactured by the method of claim 1.

8. A multilayered tube manufactured by the method of claim 2.

9. A multilayered tube manufactured by the method of claim 3.

10. A multilayered tube manufactured by the method of claim 4.

11. A multilayered tube manufactured by the method of claim 5.

12. A multilayered tube manufactured by the method of claim 6.

* * * * *